United States Patent [19]

Hasegawa

[11] Patent Number: 4,864,977

[45] Date of Patent: Sep. 12, 1989

[54] COMPRESSION RATIO-CHANGING DEVICE FOR INTERNAL COMBUSTION ENGINES

[75] Inventor: Shumpei Hasegawa, Wako, Japan

[73] Assignee: Honda Giken Kogyo Kabushiki Kaisha, Tokyo, Japan

[21] Appl. No.: 212,918

[22] Filed: Jun. 29, 1988

[30] Foreign Application Priority Data

Jul. 3, 1987 [JP] Japan ..... 62-167623

[51] Int. Cl.[4] ..... F02D 15/02

[52] U.S. Cl. ..... 123/48 B; 123/78 BA

[58] Field of Search ..... 123/48 R, 48 B, 78 R, 123/78 B, 78 BA, 78 E

[56] References Cited

U.S. PATENT DOCUMENTS 4,515,114 5/1985 Dang .
4,516,537 5/1985 Nakahara et al. .
4,602,596 7/1986 Kessler .
4,721,073 1/1988 Naruoka et al. .

FOREIGN PATENT DOCUMENTS 0026592 4/1981 European Pat. Off. ..... 123/58 A
54-106724 8/1979 Japan .
58-91340 5/1983 Japan .
0165543 9/1983 Japan ..... 123/78 B

*Primary Examiner*—David A. Okonsky
*Attorney, Agent, or Firm*—Lyon & Lyon

[57] ABSTRACT

A compression ratio-changing device for an internal combustion engine, includes an oil passageway formed through a connecting rod of the engine and connected to a hydraulic oil source. A combustion chamber volume-changing device is provided in the piston and operable by means of hydraulic pressure supplied from the hydraulic oil source through the oil passageway for changing the volume of the combustion chamber and hence changing the compression ratio of the engine. A hydraulic pressure control valve is arranged in the connecting rod for controlling the supply of the hydraulic pressure to the combustion chamber volume-changing device. A driving device is provided at a cylinder block of the engine for driving the hydraulic pressure control valve to cause the combustion chamber volume-changing device to change the volume of the combustion chamber.

17 Claims, 4 Drawing Sheets

COMPRESSION RATIO-CHANGING DEVICE FOR INTERNAL COMBUSTION ENGINES

BACKGROUND OF THE INVENTION

This invention relates to devices for changing the compression ratio of internal combustion engines, by varying the volume of a combustion chamber assumed when the piston is in the top dead center (TDC) position.

A compression ratio-changing device for an internal combustion engine is known, e.g. by Japanese Provisional Patent Publication (Kokai) No. 58-91340, which comprises an eccentric bearing interposed between the piston and the connecting rod such that the axial position of the piston relative to the connecting rod can be changed with a change in the angular position of the eccentric bearing. The device further comprises a hudraulically-operated lock pin arranged within the connecting rod for being pushed into and moved from the eccentric bearing by means of hydraulic oil pressure applied thereto so as to cause the eccentric bearing to be locked to and unlocked from the connecting rod, thereby changing the compression ratio of the engine.

However, according the prior art device, hydraulic oil pressure applied to the lock pin is supplied from two independent main oil passages, one for setting a higher compression ratio and the other for setting a lower compression ratio, formed in the cylinder block by way of respective oil passages extending through the crankshaft, crank pin, and connecting rod. These last-mentioned oil passages for feeding hydraulic oil also serving as lubricating oil require spacing for formation thereof within bearings provided in the crankshaft, crank pin, etc. Since the bearings are each disposed within a limited space, it is difficult to obtain the spacing within the bearings for formation of the dual-purpose oil passages for changing the compression ratio and lubricating the bearings. Furthermore, the aforementioned two main oil passages are selected by means of a changeover valve arranged within the cylinder block at a location upstream of the main oil passages, in other words, commands for bringing the lock pin into and out of its locking position are issued at a location considerably remote from the lock pin and transmitted to the lock pin through the long oil passageways. As a consequence, the lock pin does not move in quick response to the commands, resulting in low responsiveness in changing the compression ratio.

Another compression ratio-changing device has been proposed, e.g. by Japanese Provisional Patent Publication (Kokai) No. 54-106724, which has a hydraulic pressure chamber defined between an upper inner end face of the piston and an opposed outer end face of the piston guide which is secured to the connecting rod and axially slidably received within the piston. The piston is axially displaced relative to the piston guide by applying thereto hydraulic pressure within the hydraulic pressure chamber which is supplied from a hydraulic pressure control device provided on the cylinder block side, thereby changing the volume of the combustion chamber and hence the compression ratio of the engine.

However, according to the proposed device, the hydraulic pressure for controlling the compression ratio is supplied from the hydraulic pressure control device to the hydraulic pressure chamber by way of oil passages formed through the crankshaft, crank pin and connecting rod as well, thereby unavoidably requiring spacing within bearings of the crankshaft and the crank pin for providing the oil passages for the purpose of control of the compression ratio. In order to not only obtain spacing for the oil passages for controlling the compression ratio, but also secure lubrication of the bearings, there may be supposed two methods. That is, the first method is to provide an exclusive oil passageway for controlling the compression ratio in addition to the lubricating oil passageway, while the second method is to provide a dual-purpose oil passageway for feeding hydraulic oil for controlling the compression ratio as well as lubricating the bearings, the pressure of hydraulic oil being set to values within such a range that the hydraulic pressure can always serve to lubricate the bearings, irrespective of whether it is set to a higher value for higher compression ratio or to a lower value for lower compression ratio. However, according to the former method, it is difficult to form the exclusive oil passageway within limited spaces in the bearings. According to the latter method, on the other hand, the lower hydraulic pressure value for obtaining the lower compression ratio cannot be set to a value low enough to appropriately control the compression ratio because such a low pressure value is too low for lubrication, and if the lower pressure value is set to a value higher than such a low value, the higher hydraulic pressure value will correspondingly be excessively high, thereby necessitating increasing the capacity of the hydraulic pressure control device or the mass or weight of the piston. Further, in this prior art device, the hydraulic pressure supplied to the hydraulic pressure chamber is controlled by the hydraulic pressure control device located remotely from the hydraulic pressure chamber, thus resulting in difficulty to obtain quick displacement of the piston relative to the piston pin and hence low responsiveness in changing the compression ratio of the engine.

SUMMARY OF THE INVENTION

It is the object of the invention to provide a compression ratio-changing device for use in an internal combustion engine, which is capable of changing the compression ratio with improved responsiveness as well as securing sufficient bearing and lubricating functions of the crankshaft, etc., while it is simple in structure, requiring no substantial modification of the crankshaft, etc.

According to the present invention, there is provided a compression ratio-changing device for an internal combustion engine including a cylinder block, at least one cylinder formed in the cylinder block, a crankshaft, at least one piston received within the at least one cylinder for reciprocating therein, and at least one connecting rod connecting the at least one piston to the crankshaft, wherein a combustion chamber is defined by the cylinder and the piston, a change in the volume of the combustion chamber causing a change in the compression ratio of the engine, the device comprising:

a hydraulic oil source;

oil passage means formed through the connecting rod and connected to the hydraulic oil source;

combustion chamber volume-changing means provided in the piston and operable by means of hydraulic pressure supplied from the hydraulic oil source through the oil passage means for changing the volume of the combustion chamber;

hydraulic pressure control valve means arranged in the connecting rod for controlling the supply of the hydraulic pressure to the combustion chamber volume-changing means; and driving means provided at the cylinder block for driving the hydraulic pressure control means for causing the combustion chamber volume-changing means to change the volume of the combustion chamber.

The above and other objects, features and advantages of the invention will be more apparent from the ensuing detailed description taken in conjunction with the accompanying drawings.

DETAILED DESCRIPTION

Figure 1:
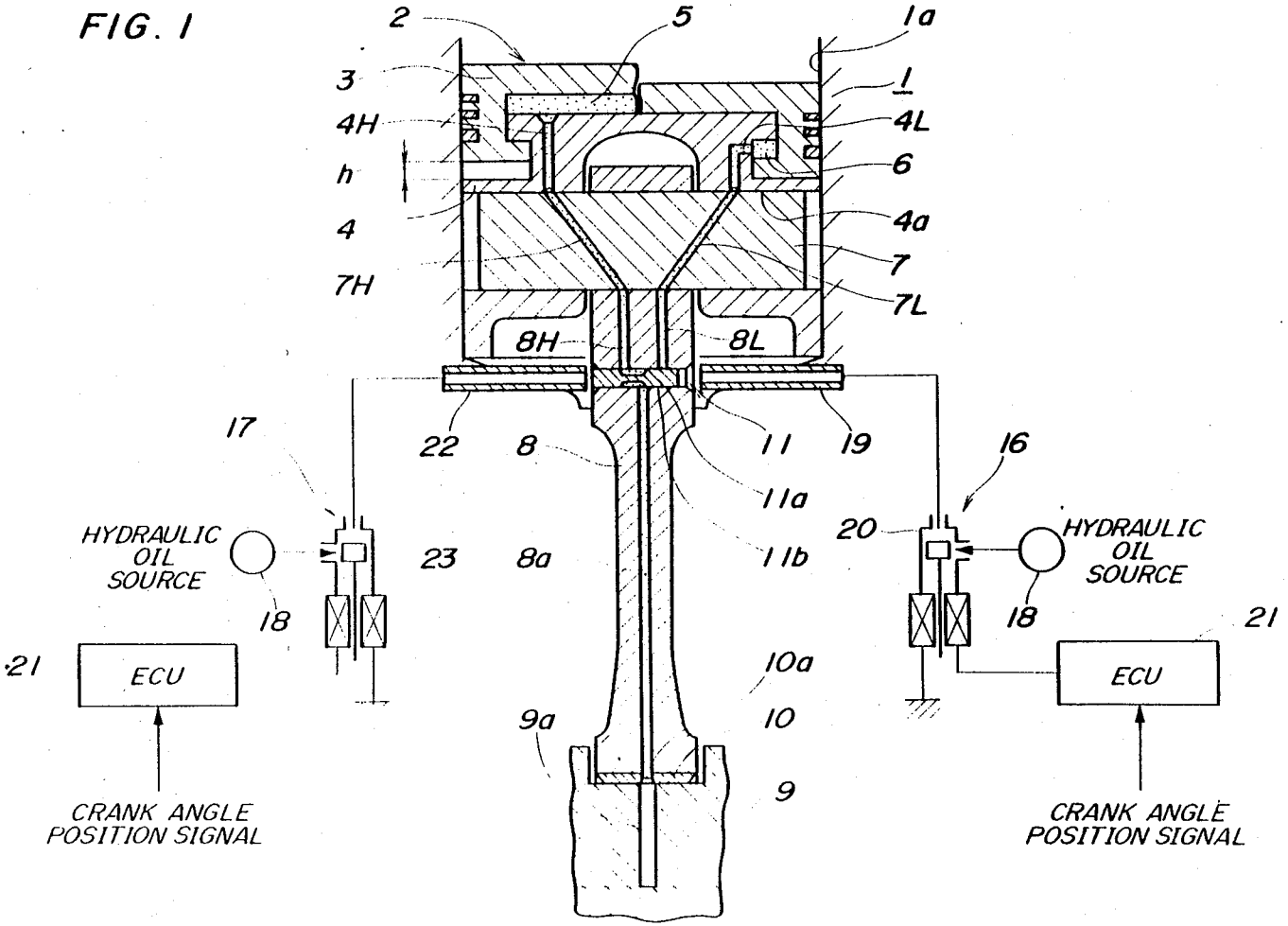
FIG. 1 is a view showing a general arrangement of a compression ratio-changing device for an internal combustion engine according to a first embodiment of the invention.

The invention will now be described in detail with reference to the drawings showing embodiments thereof. Corresponding or similar elements or parts are designated by identical reference numerals throughout all the figures, and detailed description thereof is omitted in the description of embodiments other than a first embodiment.

Figure 3:
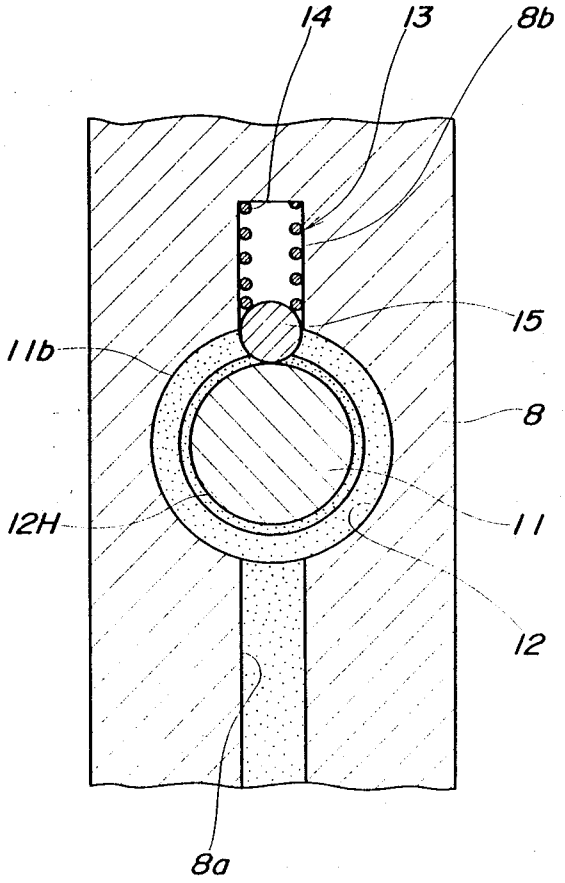
FIG. 3 is a cross-sectional view taken along line III—III in FIG. 2.
Figure 2:
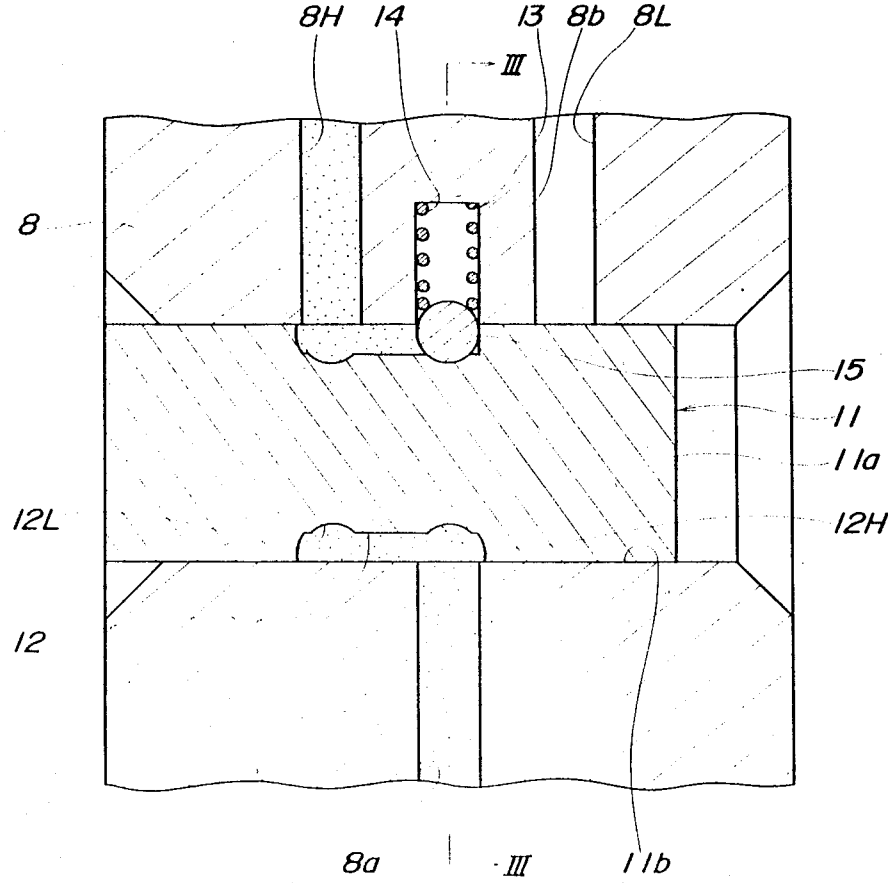
FIG. 2 is an enlarged view of an essential part of the device of FIG. 1.

FIG. 1 through FIG. 3 show a compression ratio-changing device for use in an internal combustion engine according to the first embodiment of the invention. Referring to FIG. 1, reference numeral 1 represents a cylinder block of the engine, in which cylinders 1*a* are formed, only one of which is shown. A piston 2 is slidably received within the cylinder 1*a* for reciprocating motion therein. The piston 2 comprises a movable piston head 3, right and left halves thereof being illustrated in different positions for better understanding, and a piston base 4. The movable piston head 3 is fitted on the piston base 4 such that the former is axially displaceable by a predetermined amount h relative to the latter. A higher compression ratio hydraulic chamber 5 and a lower compression ratio hydraulic chamber 6 can be defined between the members 3 and 4, as described later. A piston pin 7 has an intermediate portion thereof force-fitted through a smaller end of a connecting rod 8 and opposite end portions thereof rotatably fitted in piston pin holes 4*a* radially formed through the piston base 4. Higher compression and lower compression ratio oil passages 8H, 8L are axially formed through the smaller end of the connecting rod 8, and are always aligned, respectively, with higher compression and lower compression ratio oil passages 7H, 7L formed through the piston pin 7 in a manner extending obliquely diametrically therethrough. On the other hand, formed in the piston base 4 are a higher compression ratio oil passage 4H and lower compression ratio oil passage 4L, which communicate the higher compression ratio oil passage 7H and the lower compression ratio oil passage 7L of the piston pin 7 with the higher compression pressure chamber 5 and the lower compression pressure chamber 6, respectively, when the piston 2 is at the bottom dead center and in the vicinity thereof. Furthermore, an oil passage 8*a* is longitudinally formed through a main portion of the connecting rod 8 for feeding hydraulic oil pressure from a lubricating oil passage 9*a* formed in a crank pin 9 to the higher compression ratio oil passage 8H or the lower compression ratio oil passage 8L through a groove and hole 10*a* formed through a bearing member 10 of the crank pin 9. The lubricating oil passage 9*a* is connected to a lubricating oil source 30 to be supplied with pressurized oil pressure therefrom.

A spool valve 11 as a hydraulic pressure control valve is arranged within the smaller end of the connecting rod 8. The spool valve 11 comprises a spool valve bore 11*b* diametrically formed through the smaller end of the connecting rod 8 in a manner extending parallel with the piston pin 7, and a spool 11*a* slidably received within the spool valve bore 11*b*. The spool valve bore 11*b* has opposite end portions tapered so as to effectively receive pressurized oil jetted from oil jet pipes 19, 22 opposed thereto, hereinafter described. The higher compression and lower compression ratio oil passages 8H, 8L each have one end on the crank pin side opening into the spool valve bore 11*b*, while the oil passage 8*a* has its one end on the piston pin 7 side opening into the spool valve bore 11*a*.

The spool 11*a* has an outer periperal surface thereof formed with an annular groove 12 having a predetermined width at an axially central portion thereof, as clearly shown in FIG. 2.

With such arrangement, the spool 11*a* axially slides within the spool valve bore 11*b* so that it can assume two positions, that is, a higher compression ratio position where the oil passage 8*a* is in communication with the higher compression ratio oil passage 8H via the annular groove 12, as shown in FIG. 1, and a lower compression ratio position where the passage 8*a* is in communication with the lower compression ratio oil passage 8L via the annular groove 12, i.e., a position of the spool 11*a* rightward of the position shown in FIG. 1.

A click stop device 13 is provided between the connecting rod 8 and the spool 11*a* to retain the spool 11*a* in the higher compression or lower compression ratio position, thereby preventing the spool 11*a* from falling out of the valve bore 11*b* while sliding in the valve bore 11*b*. The click stop device 13 comprises a spring-receiving bore 8*b* formed in the connecting rod 8 and opening into the spool valve bore 11*b*, a coiled spring 14 received within the spring-receiving bore 8*b*, annular recesses 12H and 12L formed in axially opposite lateral side portions of the annular groove 12, and a steel ball 15 arranged in the annular groove 12 at the open end of the spring-receiving bore 8*b* for selective engagement by the force of the spring 14 with the annular recess 12H or 12L. Specifically, when the spool 11*a* is moved into the higher compression ratio position, the steel ball 15 is brought into engagement with the annular recess 12H, as shown in FIGS. 2 and 3, and on the other hand, when the spool is moved into the lower compression ratio position, the ball 15 is brought into engagement with the annular recess 12L.

Driving devices 16, 17 are provided in the cylinder block of the engine for forcibly displacing the spool 11*a* into the higher compression ratio and lower compression ratio positions, respectively. The driving devices 16, 17 each comprise a lubricating oil source 18, 18 for supplying lubricating oil to the engine, a higher compression or lower compression ratio oil jet pipe 19, 22 through which oil is jetted against the spool 11*a*, and a higher compression or lower compression ratio solenoid valve 20, 23 for regulating the supply of pressurized oil through the oil jet pipe 19, 22. The solenoid valves 20, 23 are controlled by an electronic control unit (ECU) 21 which receives a crank angle position signal for selectively energizing or deenergizing the solenoid valves 20, 23 over a predetermined time period or within a predetermined crank angle range with a piston bottom dead center (BDC) angle as the middle time or angle. The oil jet pipes 19, 22 are so located as to axially align with the spool 11*a* when the piston 2 assumes the BDC position and its vicinity, as shown in FIG. 1.

The operation of the compression ratio-changing device constructed as above will be described hereinbelow.

When the engine is to be brought into higher compression ratio operation as required by operating conditions of the engine, the solenoid valve 20 for higher compression ratio is energized and at the same time the solenoid valve 23 for lower compression ratio is deenergized by the electronic control unit 21 over a predetermined time period or within a predetermined crank angle range with the BDC angle as the middle time or angle, the solenoid valve 20 is opened to allow pressurized oil from the lubricating oil source 18 to pass therethrough into the oil jet pipe 19. The oil is then jetted against the spool 11*a* from the oil jet pipe 19, which is then aligned with the spool 11*a*, thereby causing the spool 11*a* to be displaced to the higher compression ratio position, as shown in FIG. 1. As a result, the oil passage 8*a* is brought into communication with the higher compression ratio oil passage 8H through the annular groove 12 of the spool 11*a*. On this occasion, the steel ball 15 is brought into engagement with the annular recess 12H of the annular groove 12 by the force of the spring 14 and holds the spool 11*a* in the higher compression ratio position. Consequently, hydraulic pressure is supplied from the lubricating oil passage 9*a* of the crank pin 9 through the groove and hole 10*a* of the bearing member 10, the oil passage 8*a*, the annular groove 12 of the spool 11*b*, and the higher compression ratio oil passages 8H, 7H, 4H into the hydraulic pressure chamber 5 for higher compression ratio, thereby causing the movable piston head 3 to be upwardly displaced relative to the piston base 4, as shown at the left half of the piston head 4 in FIG. 1. Thus, the combustion chamber 1*a* is decreased in volume and hence the engine is brought into higher compression ratio operation.

On the other hand, when the engine is to be brought into lower compression ratio operation as required by operating conditions of the engine, the solenoid valve 23 for lower compression ratio is energized and at the same time the solenoid valve 20 for higher compression ratio is deenergized by the electronic control unit 21 over the predetermined time period or within the predetermined crank angle range with the BDC angle as the middle time or angle, so that pressurized oil is jetted against the spool 11*a* through the oil jet pipe 22 which is then in alignment with the spool 11*a*, thereby causing the spool 11*a* to be shifted from the higher compression ratio position into the lower compression ratio position. As a result, the oil passage 8*a* is brought into communication with the lower compression ratio oil passage 8L through the annular groove 12 of the spool 11*a*, and the steel ball 15 is brought into engagement with the annular recess 12L of the annular groove 12 by the force of the spring 14 and holds the spool 11*a* in the lower compression ratio position. Consequently, hydraulic pressure is supplied from the lubricating oil passage 9*a* of the crank pin 9 through the groove and hole 10*a* of the bearing member 10, the oil passage 8*a*, the annular groove 12 of the spool 11*a*, and the lower compression ratio oil passages 8L, 7L, 4L into the hydraulic pressure chamber 6 for lower compression ratio, thereby causing the movable piston head 3 to be downwardly displaced relative to the piston base 4, as shown at the right half of the piston head 4 in FIG. 1. Thus, the combustion chamber 1*a* is increased in volume and hence the engine is brought into lower compression ratio operation.

In the above embodiment, the spool valve 11 as the hydraulic pressure control valve is located in the vicinity of the higher compression and lower compression ratio hydraulic pressure chambers 5 and 6 so that the total length of the oil passages between the former and the latter is reduced, thereby improving the responsiveness in changing the compression ratio of the engine.

Further, pressurized oil is jetted from the oil jet pipe 19, 22 against the spool 11*a* only after the piston 2 reaches a position near the BDC and accordingly the spool 11*b* is brought into alignment with the oil jet pipe 19, 22, which results in reduction in the amount of oil consumed and also enables setting a long oil jetting time period.

In the above embodiment, combustion chamber volume-changing means is constituted by the movable piston head 3, piston base 4, higher compression ratio hydraulic pressure chamber 5, lower compression ratio hydraulic pressure chamber 6, higher compression ratio oil passages 4H, 7H, 8H and lower compression ratio oil passages 4L, 7L, 8L.

Next, a second embodiment of the present invention will be described with reference to FIG. 4.

The second embodiment is distinguished from the first embodiment in that driving means 24 is employed for displacing the spool 11*a* by means of an electromagnetic force in place of the driving means 16, 17 of the first embodiment utilizing oil jet. The driving means 24 comprises an electric power supply 25, a pair of switches 26 operated by an electronic control unit (ECU) 21, and a pair of electromagnets 27, 27.

A spool valve 11′ comprises a spool 11*a*′ formed by a permanent magnet with magnetic poles S, N at opposite ends thereof. The electromagnets 27, 27 are disposed in opposed relation to opposite end faces of the spool 11*a*′.

Figure 4:
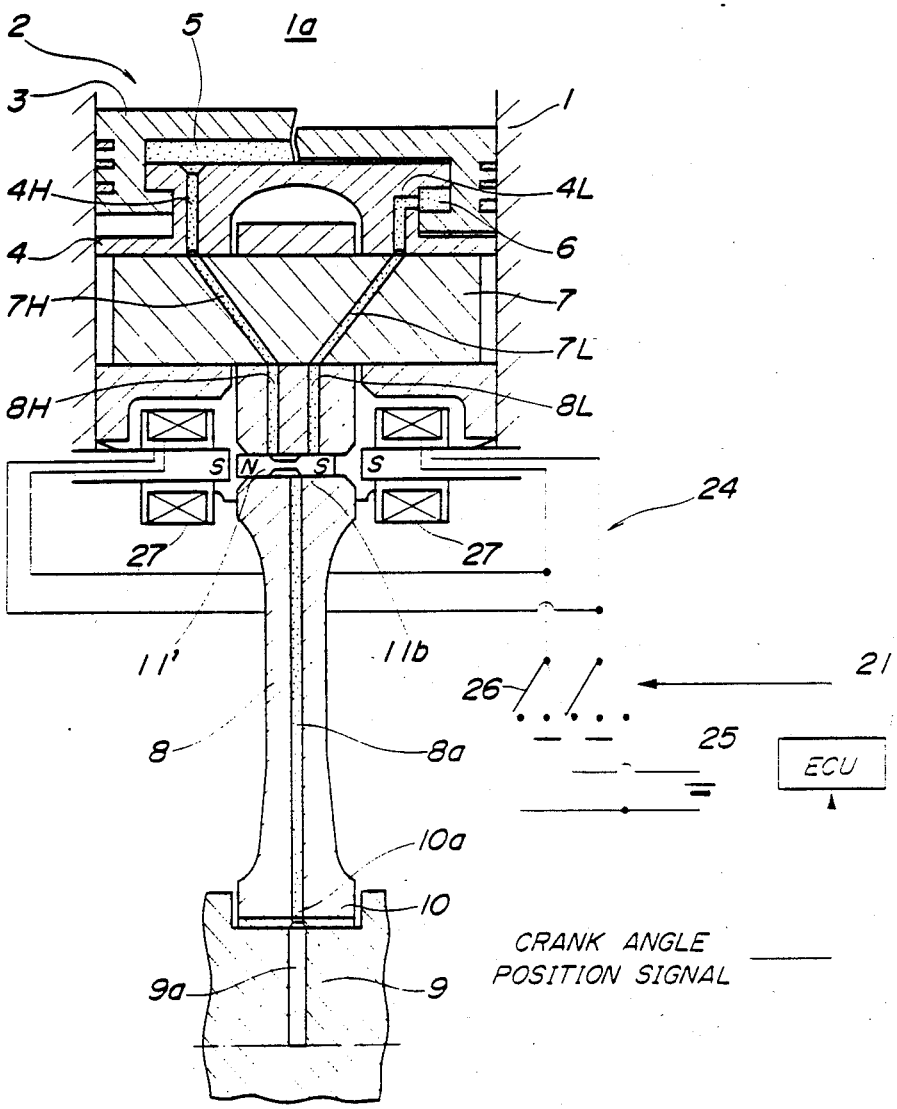
FIG. 4 is a view showing a general arrangement of a compression ratio-changing device according to a second embodiment of the invention.

With the above arrangement of the compression ratio-changing device, when the switches 26 are changed over to a higher compression ratio position by the electronic control unit 21, as shown by the solid lines in FIG. 4, the electromagnets 27, 27 both assume a polarity of S so that the spool 11*a*′ leftwardly moves and assumes a position for effecting higher compression ratio operation of the engine, as shown in FIG. 4. On the other hand, when the switches 26 are changed over to a lower compression position by the electronic control unit 21, as shown by the broken lines in FIG. 4, the electromagnets 27, 27 both assume a polarity of N so that the spool 11*a*′ rightwardly moves from the higher compression ratio position of FIG. 4 into the lower compression ratio position for effecting lower compression ratio operation of the engine.

The other elements and parts other than those referred to above are substantially identical in construction and function with corresponding ones of the first embodiment, description of which is therefore omitted.

Figure 5:
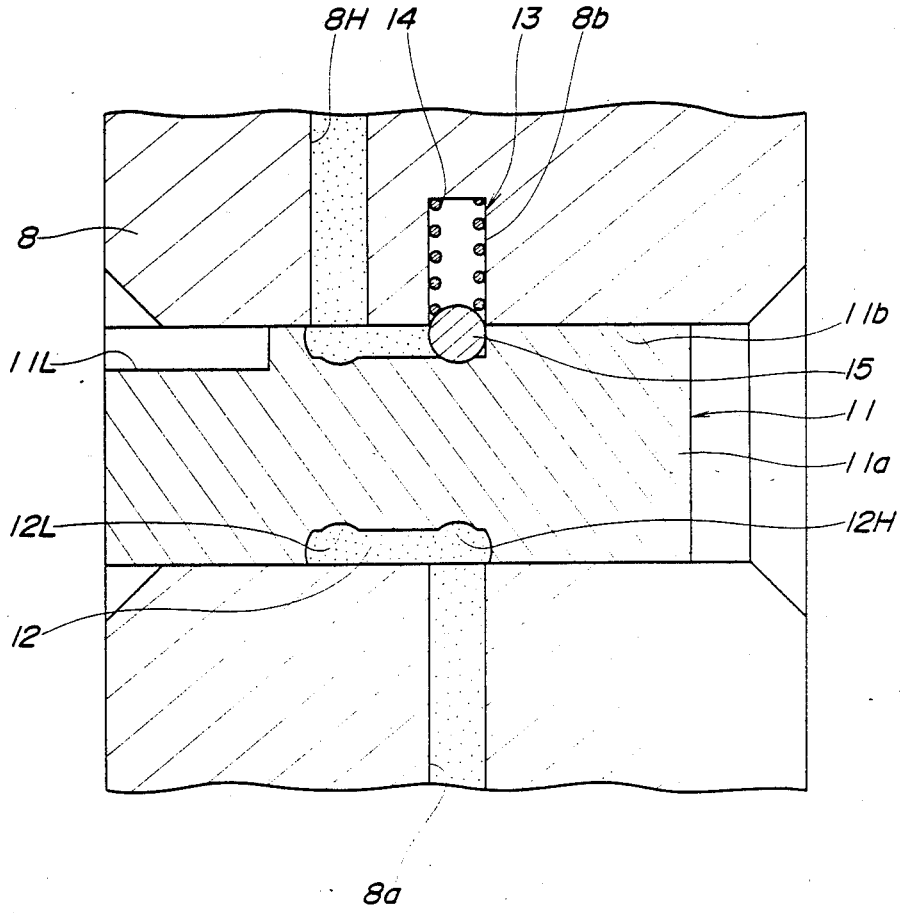
FIG. 5 is a view similar to FIG. 2, showing a third embodiment of the invention.

A third embodiment will now be described with reference to FIG. 5.

The third embodiment is distinguished from the first embodiment in that the hydraulic pressure chamber 6 for lower compression ratio, the lower compression oil passage 4L, and the lower compression ratio oil passages 8L, 7L, as employed in the first embodiment, are omitted, which constitute part of the combustion chamber volume-changing means. The spool 11*a* has an oil-leaking groove 11L axially formed in an outer peripheral surface thereof, one end of which is registrable with a higher compression ratio oil passage 8H during lower compression ratio operation of the engine and the other end opens in an end face of the spool 11*a*. The other elements and parts not referred to above are substantially identical in construction and function, description and illustration of which are therefore omitted.

According to the third embodiment, the compression ratio-changing device operates in the same manner as in the first embodiment described hereinbefore, when the engine is to be brought into higher compression ratio operation. When the engine is to be brought into lower compression ratio operation, the spool 11*a* is rightwardly shifted from the higher compression ratio position in FIG. 5 into the lower compression ratio position by the force of pressurized oil jetted thereagainst in the same manner as in the first embodiment. Then, the oil-leaking groove 11L in the spool 11*a* becomes registered and communicated with the higher compression ratio oil passage 8H so that the high pressure oil leaks from the higher compression ratio oil passage 8H through the oil-leaking groove 11L and falls to the crank pin 9 side. Consequently, no hydraulic pressure is supplied to the hydraulic pressure chamber for higher compression ratio to cause the movable piston head to downwardly move relative to the piston base 4. Thus, the volume of the combustion chamber 1*a* is increased and hence the engine is brought into lower compression ratio operation.

In the embodiments described above, other types of valves such as a rotary valve or a valve with a plate cam may be used as the hydraulic pressure control valve in place of the spool valve 11, 11'.

Furthermore, the combustion chamber volume-changing means is not limited to those employed in the above described embodiments, but it may alternatively be constituted by an eccentric bearing or an eccentric piston pin having offset axis which are arranged such that the eccentric bearing or the piston pin is locked to and unlocked from the connecting rod or the piston by means of a hydraulically-operated lock pin for changing the compression ratio of the engine, as disclosed by Japanese Provisional Patent Publication (Kokai) No. 58-91340.

What is claimed is:

1. A compression ratio-changing device for an internal combustion engine including a cylinder block, at least one cylinder having a cylinder wall formed in said cylinder block, a crankshaft, at least one piston received within said at least one cylinder for reciprocating therein, and at least one connecting rod connecting said at least one piston to said crankshaft, wherein a combustion chamber is defined by said cylinder and said piston, a change in the volume of said combustion chamber causing a change in the compression ratio of said engine, said device comprising:

a hydraulic oil source;

oil passage means formed through said connecting rod and connected to said hydraulic oil source;

combustion chamber volume-changing means provided in said piston and operable by means of hydraulic pressure supplied from said hydraulic oil source through said oil passage means for changing the volume of said combustion chamber;

hydraulic pressure control valve means arranged in said connecting rod for controlling the supply of said hydraulic pressure to said combustion chamber volume-changing means; and driving means provided at said cylinder wall for driving said hydraulic pressure control valve means for causing said combustion chamber volume-changing means to change the volume of said combustion chamber.

2. A compression ratio-changing device as claimed in claim 1, wherein said driving means is arranged to drive said hydraulic pressure control valve means when said piston is at and in the vicinity of a bottom dead center thereof.

3. A compression ratio-changing device as claimed in claim 1 or claim 2, wherein said driving means is arranged to drive said hydraulic pressure control valve by means of pressurized oil jet.

4. A compression ratio-changing device as claimed in claim 3, wherein said hydraulic pressure control valve means has a movable valve body, said driving means including means disposed in opposed relation to said valve body for jetting pressurized oil thereagainst.

5. A compression ratio-changing device as claimed in claim 1 or claim 2, wherein said driving means is arranged to drive said hydraulic pressure control valve means by means of an electromagnetic force.

6. A compression ratio-changing device as claimed in claim 5, wherein said hydraulic pressure control valve means has a movable valve body comprising a permanent magnet, said driving means comprising electromagnetic means disposed in opposed relation to said valve body and being changeable in polarity.

7. A compression ratio-changing device as claimed in claim 1 or claim 2, wherein said combustion chamber volume-changing means is arranged to increase the volume of said combustion chamber for obtaining a higher compression ratio of the engine and to decrease the volume of said combustion chamber for obtaining a lower compression ratio of the engine, said hydraulic pressure control valve means being arranged to assume a first position for causing said combustion chamber volume-changing means to obtain said higher compression ratio and a second position for causing said combustion chamber volume-changing means to obtain said lower compression ratio.

8. A compression ratio-changing device as claimed in claim 7, wherein said combustion chamber volume-changing means comprises first and second oil passages extending within said piston, and means connected to said first and second oil passages for decreasing the volume of said combustion chamber in response to hydraulic pressure supplied through said first oil passage to obtain said higher compression ratio and for increasing the volume of said combustion chamber in response to hydraulic pressure supplied through said second oil passage to obtain said lower compression ratio.

9. A compression ratio-changing device as claimed in claim 8, wherein said hydraulic pressure control valve means is arranged to allow said hydraulic pressure from said hydraulic oil source to be selectively supplied to said first and second oil passages of said combustion chamber volume-changing means.

10. A compression ratio-changing device as claimed in claim 7, wherein said combustion chamber volume-changing means comprises a single oil passage extending within said piston, and means connected to said single oil passage for setting the volume of said combustion chamber to a value for obtaining one of said higher compression ratio and said lower compression ratio when hydraulic pressure is supplied thereto through said single oil passage, and for setting the volume of said combustion chamber to a value for obtaining the other of said higher compression ratio and said lower compression ratio when no hydraulic pressure is supplied thereto through said single oil passage.

11. A compression ratio-changing device as claimed in claim 10, wherein said hydraulic pressure control valve means is arranged to selectively allow and interrupt the supply of said hydraulic pressure from said hydraulic oil source to said single oil passage of said combustion chamber volume-changing means.

12. A compression ratio-changing device as claimed in claim 1, wherein said hydraulic pressure control valve means comprises a valve bore formed through said connecting rod in a manner extending substantially parallel with an axis of said crankshaft, and a spool slidably received within said valve bore.

13. A compression ratio-changing device as claimed in claim 12, including a first oil passage longitudinally formed in said connecting rod, said first oil passage having one end thereof connected to said hydraulic oil source and another end thereof opening into said valve bore of said hydraulic pressure control valve means, and second and third oil passages formed in one end portion of said connecting rod on the piston side, said second and third oil passages each having one end thereof opening into said valve bore and another end thereof connected to said compression chamber volume-changing means, wherein said combustion chamber volume-changing means is arranged to decrease the volume of said combustion chamber in response to hydraulic pressure supplied through said second oil passage for obtaining a higher compression ratio of the engine and to increase the volume of said combustion chamber in response to hydraulic pressure supplied through said third oil passage for obtaining a lower compression ratio of the engine, said spool being slidably movable within said valve bore for connecting said first oil passage selectively to said second oil passage and said third oil passage.

14. A compression ratio-changing device as claimed in claim 12, including a first oil passage longitudinally formed in said connecting rod, said first oil passage having one end thereof connected to said hydraulic oil supply source and another end thereof opening into said valve bore of said hydraulic pressure control valve means, and a second oil passage formed in one end portion of said connecting rod on the piston side, said second oil passage having one end thereof opening into said valve bore and another end thereof connected to said combustion chamber volume-changing means, wherein said combustion chamber volume-changing means is arranged to set the volume of said combustion chamber to a value for obtaining one of a higher compression ratio o the engine and a lower compression ratio of the engine when hydraulic pressure is supplied thereto through said second oil passage and to set the volume of said combustion chamber to a value for obtaining the other of said higher compression ratio and said lower compression ratio when no hydraulic pressure is supplied thereto through said second oil passage, said spool being slidably movable within said valve bore for selectively connecting and disconnecting said first oil passage to and from said second oil passage.

15. A compression ratio-changing device as clamed in any of claims 12–14, wherein said driving means comprises a pair of members disposed in said cylinder block in opposed relation to opposite ends of said valve bore of said hydraulic pressure control valve means for generating driving forces acting upon said spool to displace same.

16. A compression ratio-changing device as claimed in claim 1 or claim 2, wherein said hydraulic pressure control valve means is arranged to assume a plurality of predetermined positions, said device including means for holding said valve means in each of said predetermined positions after said valve means has assumed said each predetermined position.

17. A compression ratio-changing device as claimed in claim 1 or claim 2, wherein said hydraulic pressure control valve means is arranged at one end portion of said connecting rod on the piston side.

* * * * *